US005239777A

United States Patent [19]

Husselton

[11] Patent Number: 5,239,777

[45] Date of Patent: Aug. 31, 1993

[54] OVERHEAD DOOR PRE-LOADED AND PRE-ASSEMBLED TORSION SPRING COUNTERBALANCE ASSEMBLY

[75] Inventor: Mahlon E. Husselton, Kissimmee, Fla.

[73] Assignee: Atlas Roll-Lite Door Corporation, Orlando, Fla.

[21] Appl. No.: 857,027

[22] Filed: Mar. 24, 1992

[51] Int. Cl.[5] ..... E05F 11/00

[52] U.S. Cl. ..... 49/200; 49/506; 160/191

[58] Field of Search ..... 49/200, 197, 506; 160/191, 192, 189, 190

[56] References Cited

U.S. PATENT DOCUMENTS 3,038,535 6/1962 Stroup et al. ..... 160/191

3,412,423 11/1968 Binns ..... 49/200 X

*Primary Examiner*—Philip C. Kannan

*Attorney, Agent, or Firm*—Leon E. Redman; Malcolm L. Sutherland

[57] ABSTRACT

A torsion spring counterbalance assembly having one end of a torsion spring attached to a center support bracket with the other end attached to a torsion shaft around which the torsion spring is pre-loaded with the torsion shaft releasably locked to the center support bracket for allowing the tension of the pre-loaded torsion spring to be released after installation with an overhead garage door to counterbalance the garage door between open and closed positions via lift bands wound about drums mounted at the ends of the torsion shaft and secured to the door bottom by wire brackets. The drums are selectively connected for rotation with the torsion shaft and disconnected from rotation with the torsion shaft to permit adjustment of the tension and resulting torque of the torsion spring. A safety interlock mechanism limits the rotation of the torsion shaft relative to the center support bracket in the event of a malfunction upon initial installation. A manually actuated eccentric cam selectively locks and unlocks the lift band drums for lateral adjustment of the drums on the torsion shaft to properly align the spacing of the drums relative to variations in door width. A sleeve inside the torsion spring maintains the length of the torsion spring at its fully wound position to prevent lateral thrust on torsion shaft end supports enabling a single spring to be used on garage doors of various sizes and weights.

16 Claims, 6 Drawing Sheets

FIG. 1.
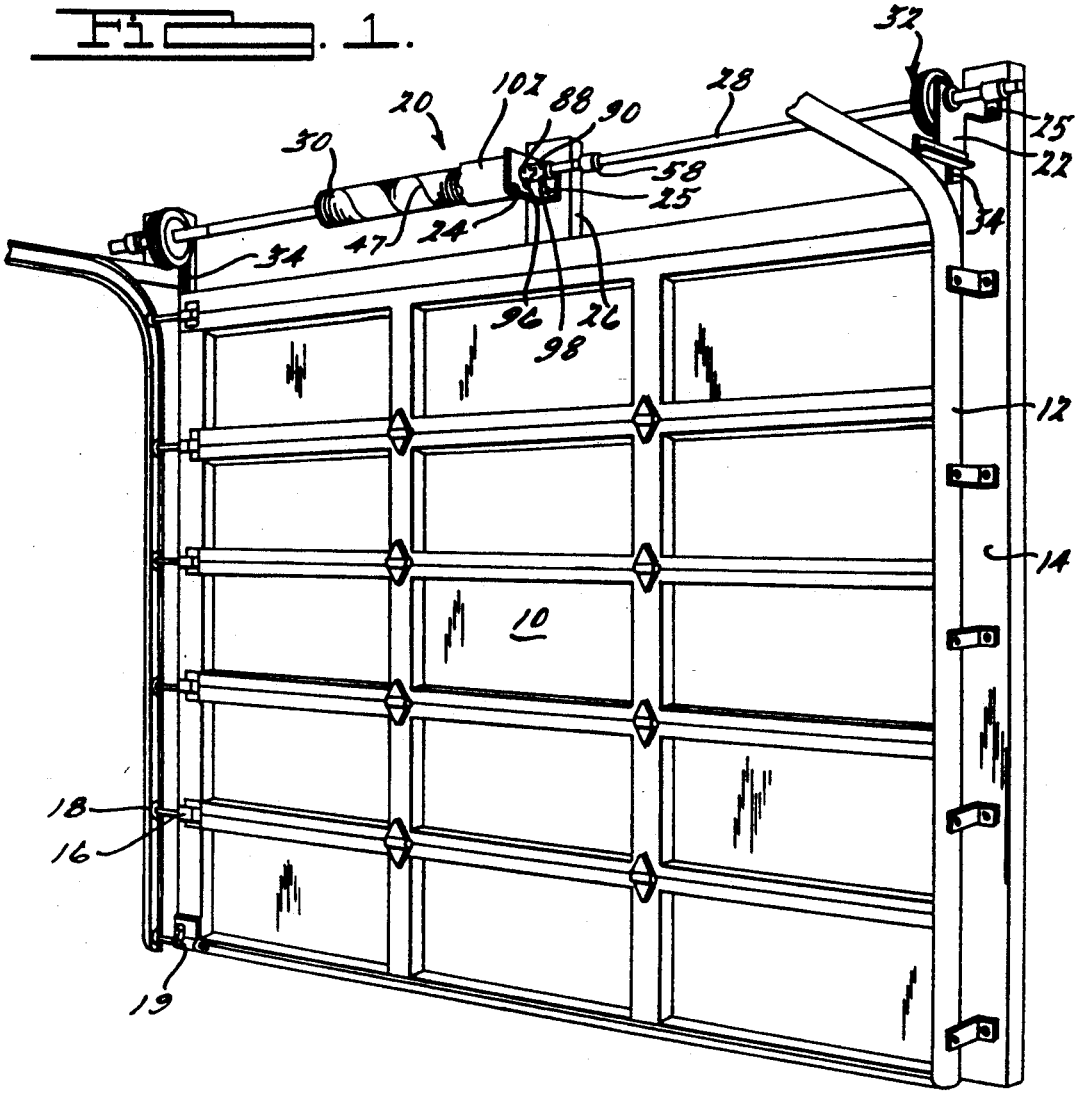
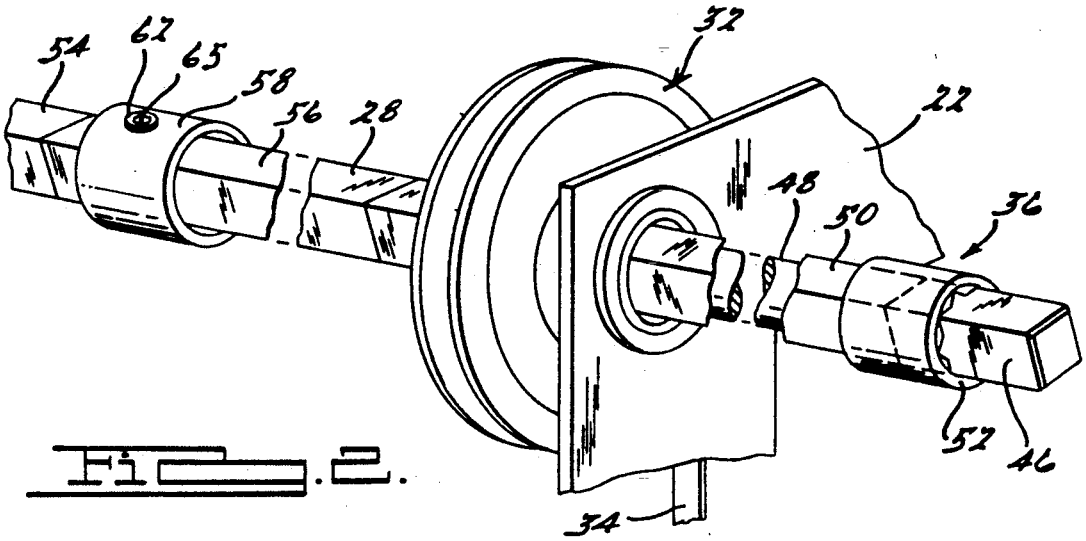
FIG. 2.

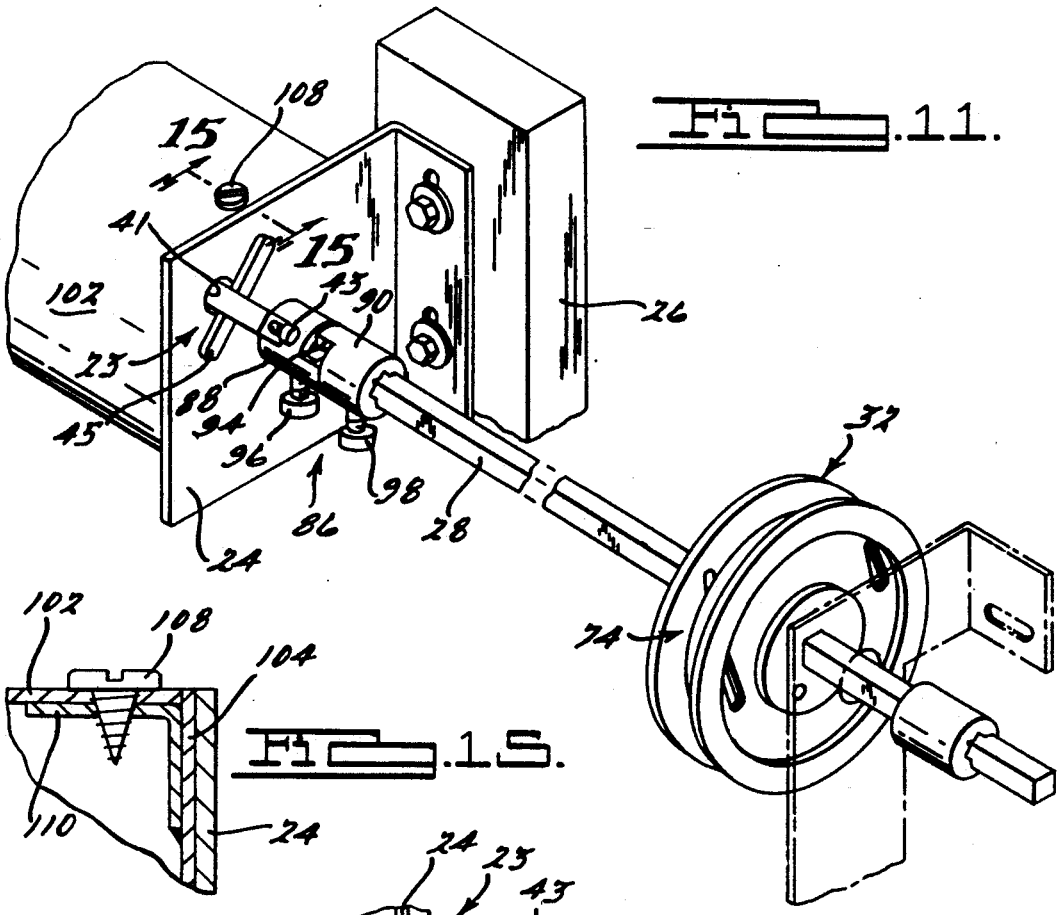
FIG. 11.
FIG. 15.
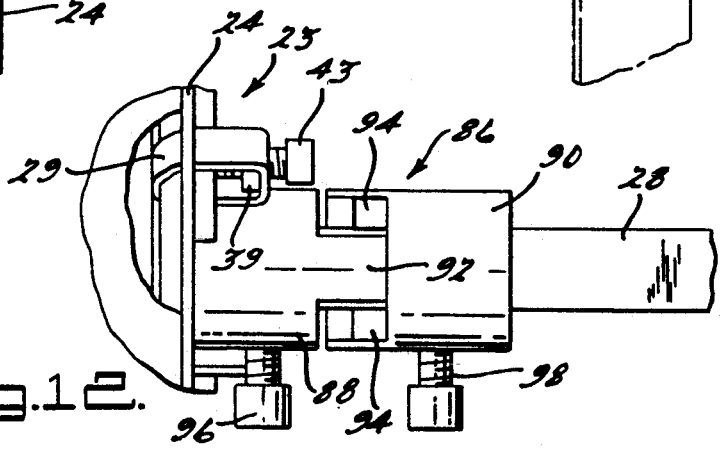
FIG. 12.
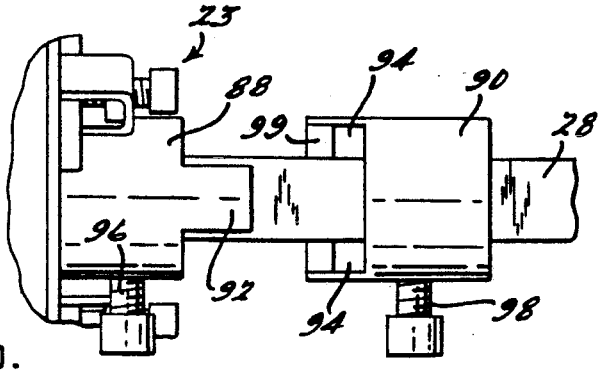
FIG. 13.

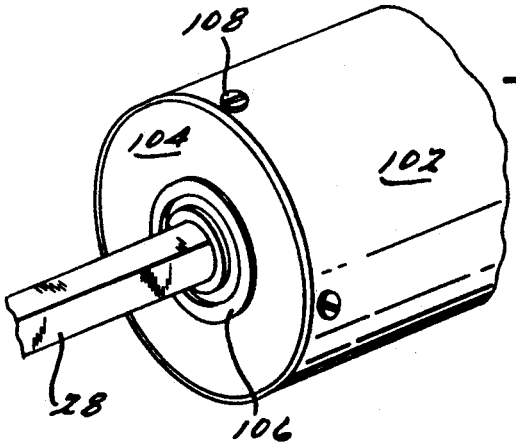
FIG. 14.
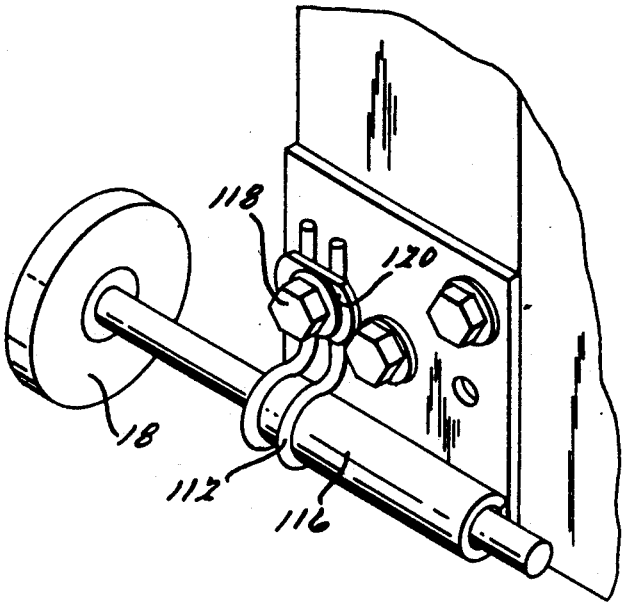
FIG. 16.
FIG. 17.
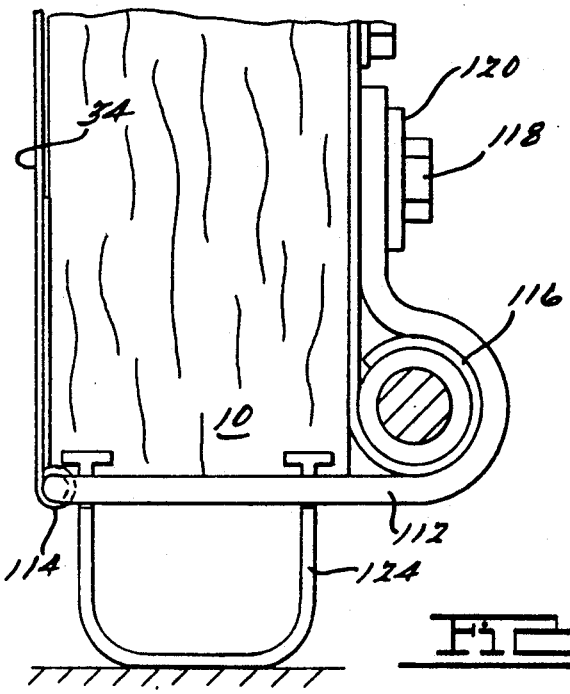
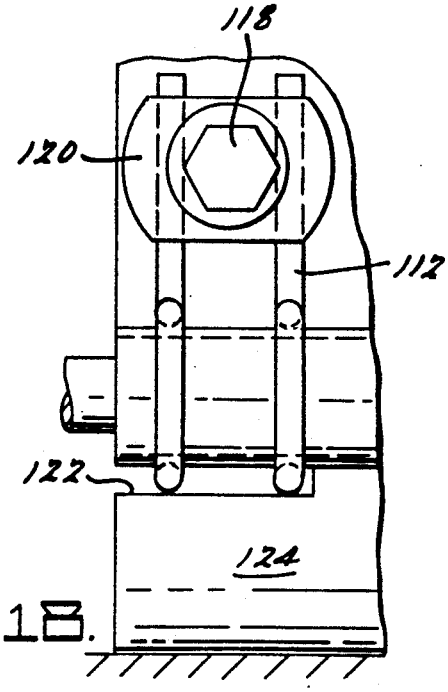
FIG. 18.

OVERHEAD DOOR PRE-LOADED AND PRE-ASSEMBLED TORSION SPRING COUNTERBALANCE ASSEMBLY

BACKGROUND OF THE INVENTION

The present invention relates generally to a counterbalance mechanism to counterbalance the weight of an overhead garage door during opening and closing movements and in particular to a counterbalance torsion spring assembly and the method of installation and adjustment of the counterbalance torsion spring to an overhead garage door.

Torsion spring counterbalancing mechanisms have been employed for many years to counterbalance overhead garage doors as they move up to an open position and down to a closed position. Until the present invention, installation of torsion spring counterbalance mechanisms for operation with the garage door required winding the torsion spring until a desired torque is achieved for desired counterbalancing. Frequently, this involves repeated trial and error manual winding and unwinding maneuvers against the high torque of the torsion spring until the proper balance against the weight of the garage door is achieved. Presently, such maneuvers involve the use of one successively or two lever bars that are successively inserted into circumferentially spaced apart sockets or openings in a plug or spider at a free end of the torsion spring. Initially, the installer, using the lever bar rotates the free end of the torsion spring in the direction that winds the torsion spring relative to the fixed end of the torsion spring. As the torsion spring is wound it produces a tremendous unwinding torque. The lever bar must be repeatedly removed from and reinserted into a different socket or opening in the plug or spider at the end member in order for the installer to maintain leverage against the tremendous unwinding torque and prevent a violent unwinding of the torsion spring. It is also necessary to similarly use a second lever bar or other tool to hold the torsion spring in place while the other lever bar is repositioned. A typical installation requires 28 such maneuvers as the torsion spring requires 28 quarter turns to be fully wound. When winding has been completed it is necessary to secure the free end of the torsion spring to the torsion shaft. Typically, two torsion springs are employed and each must be carefully wound and properly adjusted upon installation of the garage door and counterbalance mechanism to the surrounding garage door framework.

Various attempts have been made in the prior art to address this situation and to reduce the possibility of a violent unwinding of the torsion spring as it is wound upon installation. Examples of such attempts are self-locking worm gear mechanisms disclosed in U.S. Pat. No. 3,921,761 to Votroubek et al and U.S. Pat. No. 4,882,806 to Davis. However, such self-locking worm gear mechanisms still require the time and labor involved in performing an initial winding operation during installation. Furthermore, such mechanisms also add to the complexity and cost of a torsion spring counterbalance assembly while detracting from its reliability and do not provide for independent adjustment of the winding drum or reels as provided by the present invention.

It is an object of the present invention to eliminate winding of a counterbalance torsion spring for an overhead garage door during installation to improve the safety while reducing the time and labor of such installation.

It is a further object of this invention to provide a torsion spring counterbalance mechanism in which the torsion spring is prewound and the counterbalance mechanism is pre-assembled prior to installation.

It is a further object of this invention to facilitate adjustment of the tension of the torsion spring at either end of the torsion shaft with the garage door in the open position with minimum unwinding torque from the torsion spring.

It is a further object of this invention to enable the torsion spring counterbalance assembly to be installed and serviced with standard tools, obviating the use of lever bars, by other than experienced professional garage door installers and service personnel.

It is a further object of this invention to independently adjust the length of a winding band wound about separate winding drums disposed on each side of the garage door for proper leveling of the garage door relative to the counterbalance mechanism.

It is a yet further object of this invention to provide a torsion spring counterbalance mechanism for an overhead garage door that not only has the above advantages but also uses a minimum number of parts that are standardized and non-handled to the fullest extent possible with an accompanying reduction in inventory costs at both the factory and distributor.

SUMMARY OF THE INVENTION

These and various other objects of this invention are accomplished by a torsion spring counterbalance assembly for an overhead garage door which employs a torsion spring pre-wound about and releasably secured in a pre-loaded condition to a torsion shaft. Winding drums are provided adjacent opposite ends of the torsion shaft with the winding drums rotatably mounted thereon. A manually actuated locking device secures the winding drum to the torsion shaft for rotation therewith to alternately raise or lower the garage door via flexible lift bands extending between the lower end of the garage door and the winding drum. The locking device can be manually actuated to permit the winding drum to be rotated about the torsion shaft for adjustment of the tension of the torsion spring and the length of the lift band from the winding drum to the lower end of the garage door. A safety collar is mounted on the torsion shaft and movable between an operative and an inoperative position. While in the operative position the safety collar limits the rotation of the torsion shaft upon the initial release of the torsion spring tension if the counterbalance assembly has not been properly secured to the garage door surrounding framework, a part should break or become loose, or other malfunction should occur. The safety collar also provides a visual indication that the counterbalance mechanism has been properly installed.

BRIEF DESCRIPTION OF THE DRAWINGS

FIG. 1 is a fragmentary perspective view from the inside of a garage showing an overhead garage door, door tracks and the torsion spring counterbalance assembly of the present invention as initially installed prior to release of the torsion spring tension with the safety collar in the operative position;

FIG. 3 is a slightly enlarged front elevational view with the torsion spring cover and torsion spring broken away;

FIG. 11 is an enlarged fragmentary perspective of the right drum band and drum lock collar on the torsion shaft which is foreshortened to show the center support bracket with the safety stop mechanism and the spring attachment;

FIG. 2 is a greatly enlarged fragmentary front elevational view of the safety stop mechanism and spring attachment of FIG. 11 in the operative position;

FIG. 13 is a greatly enlarged fragmentary front elevational view of the safety stop mechanism and spring attachment of FIG. 11 with the safety stop collar moved away from the safety stop locking collar and the spring cover broken away to show the spring attachment mechanism;

FIG. 14 is an enlarged fragmentary perspective view of the left end of the spring cover with the torsion shaft journaled therethrough;

FIG. 15 is a greatly enlarged cross-section taken along line 15—15 of FIG. 11;

FIG. 16 is a greatly enlarged fragmentary perspective view of the lower left hand inside corner of the garage door showing attachment of the lift band bottom wire bracket to the bottom roller bracket;

FIG. 17 is a greatly enlarged fragmentary left side elevation of the lift band attachment of FIG. 16;

FIG. 18 is a greatly enlarged front elevation of the band attachment of FIG. 16; and FIG. 19 is an enlarged fragmentary perspective view of the inside of the upper front section of the right guide track with a temporary clamp below the right bottom roller to hold the garage door in the open position for adjustment of torsion spring tension.

DESCRIPTION OF THE PREFERRED EMBODIMENT

Figure 2:
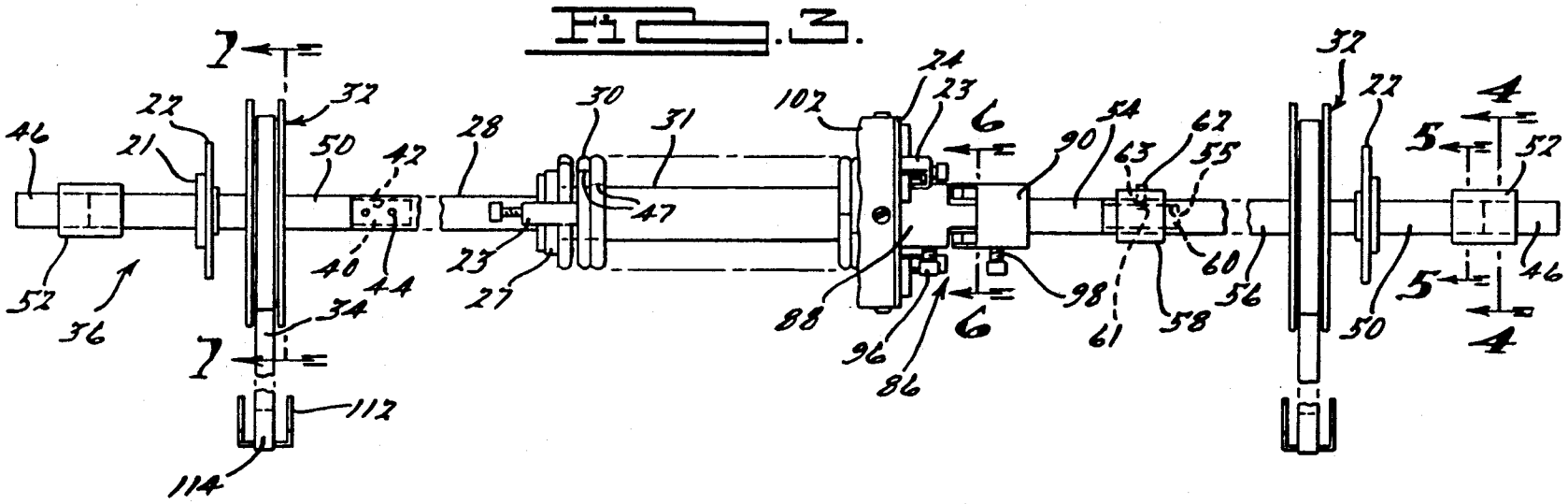
FIG. 2 is an enlarged fragmentary perspective view of an end of the torsion shaft of the present invention showing a coupling collar securing segments of the torsion shaft together, winding drum rotatable about the torsion shaft for tension adjustment, an end support with a bearing, and a locking collar to secure the winding drum to the torsion shaft for rotation therewith.
Figure 6:
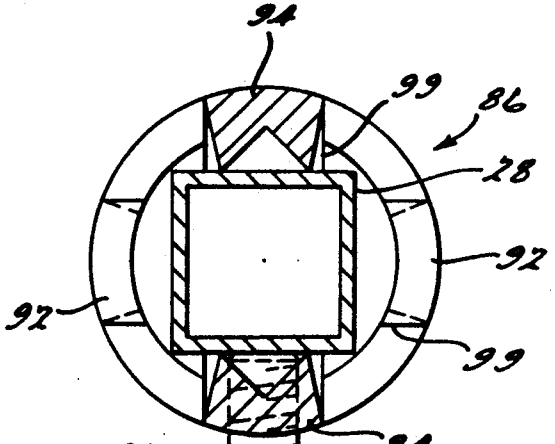
FIG. 6 is a greatly enlarged cross-section along the line 6—6 of FIG. 3.

In the drawings, the preferred embodiment of the present invention is a pre-loaded and pre-assembled torsion spring counterbalance assembly for an overhead garage door. Referring to FIG. 1 a conventional overhead garage door 10 is shown mounted via a pair of guide tracks or channels 12 to the inside of a garage wall in which a doorway is formed by door frame members 14. The garage door can include a plurality of roller mechanisms 16 each having a roller 18 supported and guided in the guide tracks 12 for movement between a closed position shown in FIG. 1 and an open overhead position in a conventional fashion. The counterbalance mechanism generally referred to as 20 is mounted above the door 10 and secured via standard end support brackets 22 to the door frame members 14 and via a center support bracket 24 to a door frame header 26 via conventional lag bolts 25. The counterbalance mechanism or assembly 20 comprises a torsion shaft 28 rotatably journaled in bearings 21 provided in the end support brackets 22 and center support bracket 24 along with band drums or reels 32 disposed at opposite ends of torsion shaft 28. The bearings 21 in the end support brackets 22 are conventional ball bearing/raceway assemblies. A flexible lift band 34 is wound about each band drum 32 with its lower end connected to the bottom section of the garage door 10 via a bottom band attachment bracket 19 so that as the torsion shaft 28 is rotated by the unwinding of the torsion spring 30 the flexible lift band 34 is wound about the band drums 32 thereby lifting the garage door 10. As will be described hereinafter in further detail, one end of the torsion spring 30 is attached to the center support bracket 24 and the other end is attached to the torsion shaft 28 for rotation therewith.

Referring to FIGS. 3, 11 and 12, one end of the torsion spring 30 is attached to the center support bracket 24 via a pair of diametrically opposed fasteners 23. The other end of the torsion spring 30 is attached to the torsion shaft 28 via bracket 27 and fasteners 23. Each fastener 23 is provided with a loop 29 at one end through which the end coil of spring 30 is received and a threaded nut 39 is provided at the other end. The loop end 29 with the end coil constrained therein is disposed on the inward side of the center support bracket 24 with the remainder of fastener 23 extending laterally outwardly therefrom through a suitable aperture 41 provided therein. A screw 43 extending laterally inward through the fastener nut 39 engages a pressure brace 45 disposed on the outward side of the center support bracket 24 spanning the aperture 41 through which the fastener 23 extends. At least two spaced apart apertures are provided in the center support bracket 24 to secure the end coil via fasteners 23 on opposite sides of such end coil. Such spaced apart apertures are similarly provided in the end spring bracket 27 to receive at least two fasteners 23 therein to similarly secure the other end coil of spring 30 to bracket 27. Bracket 27 is provided with a centrally disposed square aperture complementary to the outer configuration of the torsion shaft 28 so that the left or free end of the torsion spring 30 rotates therewith. Prior to installation and preferably at the factory, the torsion shaft with the free end of the torsion spring 30 attached thereto is mechanically wound a predetermined number of turns relative to the center support bracket 24 using conventional machinery and fixtures which do not constitute part of this invention and therefore are not shown. For a typical seven foot high garage door, the free end of the torsion spring 30 is wound approximately seven and one-half turns. The pre-wound torsion spring 30 is then locked in this pre-wound state via locking screw 96 threadably extending through a wall of a locking collar 88 which is welded or otherwise fixedly attached to one side of the center support bracket 24. The locking collar 88 also is part of a safety interlock mechanism 86 which will be described later in further detail.

Prior to the mechanical winding of the torsion spring 30 as described above, a straight line is painted or otherwise applied longitudinally across the outside of the coils of the torsion spring 30. As the torsion spring winds and unwinds this line forms a helix pattern corresponding to the number of turns that the torsion spring 30 is wound. This provides a visual indication of the winding and unwinding of the torsion spring 30. Thus, with the torsion spring fully wound to seven and one-half turns, the helix pattern will have seven and one-half diagonal stripes 47 across the torsion spring 30. With the garage door 10 in a full open position the torsion spring 30 will be wound approximately one turn and the helix pattern will have only a single diagonal stripe.

A circular cylindrical spring sleeve 31 having a diameter less than the inside diameter of the torsion spring 30 in its pre-wound and pre-stretched state is disposed about the square shaft 28 and extends laterally from one end of the torsion spring 30 to the other between the inside of the center support bracket 24 and the inside of bracket 27. The sleeve 31 thus maintains the free end of the torsion spring 30 in a fixed lateral position relative to the torsion shaft 28 as the torsion spring unwinds and rewinds and transmits all lateral thrust to the center support bracket 24. This prevents the free end of torsion spring 30 and the torsion shaft 28 from moving laterally which movement would result in an undesirable end thrust on bearings 21 in the end support brackets 22.

Maintaining the free end of the torsion spring 30 in such a fixed lateral position enables the counterbalance mechanism 20 to properly function with only a single torsion spring 30 on any size garage door 10 without undesirable lateral forces being produced that would otherwise cause misalignment of the drums 23 as the torsion shaft 28 moved laterally. This is in contrast to conventional counterbalance mechanisms that require two oppositely wound torsion springs to be mounted in a back-to-back relationship for the purpose of cancelling the lateral force produced by each of the two springs.

Figure 5:
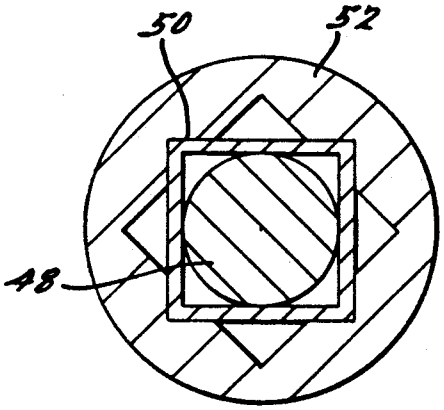
FIG. 5 is a greatly enlarged cross-section along the line 5—5 of FIG. 3.
Figure 4:
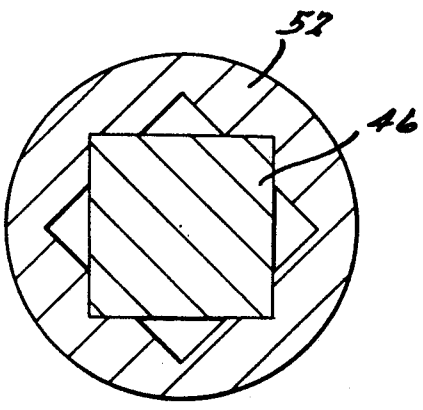
FIG. 4 is a greatly enlarged cross-section along the line 4—4 of FIG. 3.
Figure 7:
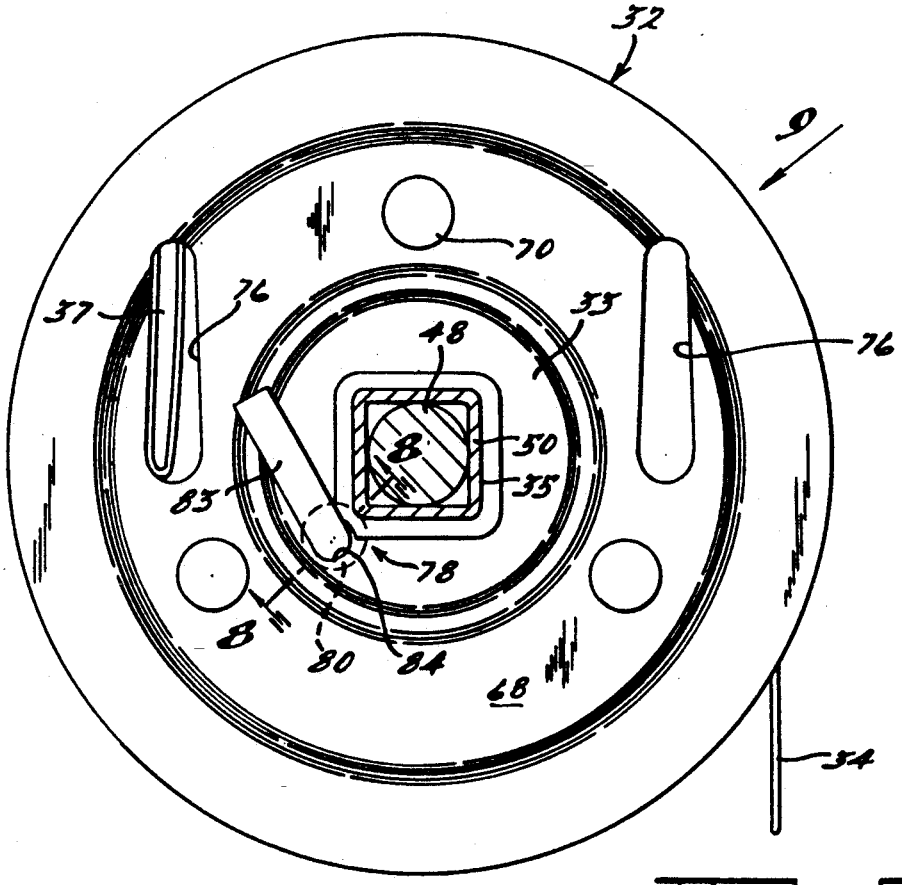
FIG. 7 is a greatly enlarged cross-section along the line 7—7 of FIG. 3.
Figure 8:
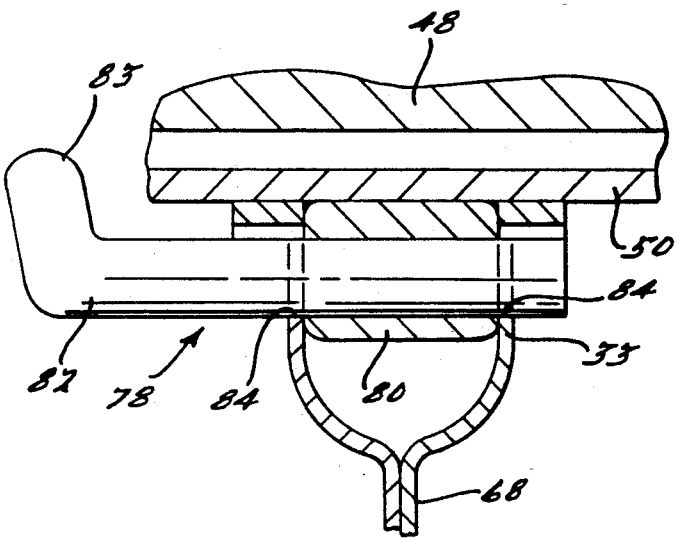
FIG. 8 is a greatly enlarged cross-section along the line 8—8 of FIG. 7.
Figure 9:
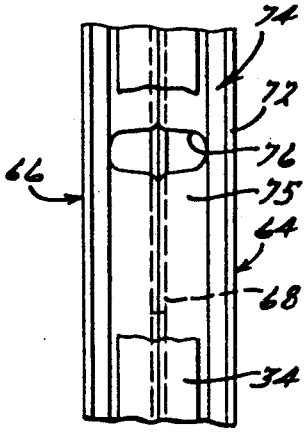
FIG. 9 is a fragmentary elevational view looking in the direction of arrow 9 of FIG. 7 with the lifting band broken away to show the band receiving slot of the band drum.
Figures 9, 10:
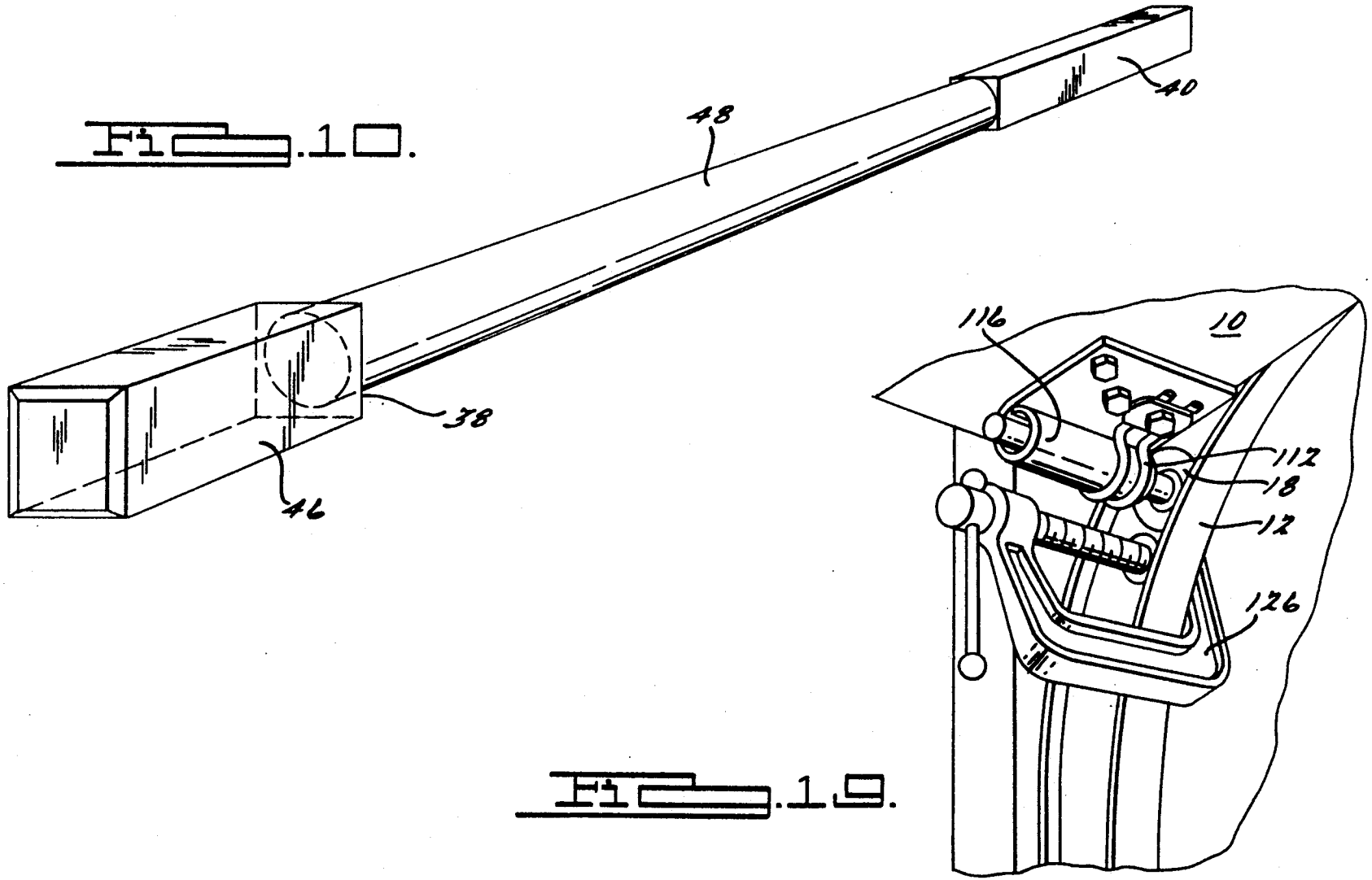
FIG. 10 is an enlarged perspective view of the internal drum shaft.

Referring to FIGS. 2–5 and 10, an important aspect of the present invention is the capability of the band drums 32 to be separately and independently rotated about the torsion shaft 28 in order to adjust the length of the flexible lift band 34 on each side of the garage door to provide for proper leveling and to enable the bands to be tightened around the band drums prior to release of the tension of the pre-wound torsion spring 30 during initial installation. In the preferred embodiment, this is accomplished by forming the torsion shaft 28 from an elongated tubular member having a square cross-section configuration with a combination drum support and spring adjustment assembly generally referred to at 36 at opposite ends of the torsion shaft 28. The drum support and spring adjustment assembly 36 includes internal shaft extension member 38 having an inner end 40 telescopically received in a cavity 42 provided at the outer end of the central portion of the torsion shaft 28 and fixedly secured thereto by a pair of pins 44. The outer end 46 of the shaft extension member 38 has a square cross-section configuration the same dimension as the central portion of the torsion shaft 28. A round shaft portion 48 is disposed between the inner and outer ends 40 and 46. The inner end 40 is formed in a square cross-section configuration with sides having the same dimension as the diameter of the round shaft portion 48. A hollow outer rotating tube 50 having a square cross-section configuration surrounds the round shaft portion 48 and extends laterally between the inner and outer ends 40 and 46 and has an interior which is configured to permit the hollow outer rotating tube 50 to freely rotate about the round shaft portion 48. The exterior configuration of the tube 50 is square and matches the exterior configuration of the outer end 46. A locking collar 52 has a star shaped interior which is complementary to the exterior of the outer end 46 and the outer rotating tube 50 in either of two orientations as best seen in FIGS. 4 and 5. This permits the locking collar 52 to slidably engage the exterior of both the outer end 46 of the shaft extension member 38 as well as the outer end of the outer rotating tube 50 even if tube 50 is rotated at a 45° angle relative to the outer end 46 such that the flat sides do not align. This permits the locking collar 52 to lock the square rotating tube 50 to the shaft extension member 38 to provide a more precise adjustment of one relative to the other in order to more precisely adjust the tension of the torsion spring as will be explained in further detail later.

The drums 32 are each provided with a hub 33 having a square opening complementary to the square outer tube 50 so that the drums 32 are rotatable therewith.

The torsion shaft 28 can be provided in two or more mating segments 54, 56 secured together by a coupling collar 58. This significantly reduces the length of the packaging required for shipment of the shaft 28 of the present invention resulting in an overall more compact package which facilitates shipping and storage of the assembly 20. One segment 54 is provided with a tongue 60 that is telescopically received in a complementary configured cavity 55 in the mating end of section 56. The tongue 60 is provided with a recess 61 that is aligned with a threaded hole 63 extending from the outer surface to the cavity 55 in the mating end of the segment 56. The coupling collar 58 is provided with a threaded hole 65 extending through one wall to receive a threaded set screw 62 which extends through the wall of the coupling collar 58 and the threaded hole 63 in segment 56 and is seated in the recess in the coupling tongue 60 thereby securing the mating segments 54 and 56 together as shown in FIGS. 2 and 3.

Referring to FIGS. 7–11, each of the band drums 32 is formed by a matching pair of drum halves 64, 66 each provided with a centrally disposed annular web 68. The opposing webs 68 of the drum halves 64, 66 are fastened together by rivets 70 circumferentially spaced about the web or alternatively the opposing webs 68 are held together by welding. Each drum half 64 and 66 is also provided with an annular flange 72 and a central hub 33 both offset laterally from the annular web 68. The opposing annular flanges 72 of the matched drum halves 64, 66 form a channel 74 in which the flexible lift band 34 may be wound. A pair of slots 76 extend through the bottom wall 75 of channel 74 into the annular web 68. Slots 76 are parallel to each other and spaced equidistant from the center of hub 33. The slots 76 are provided to receive a loop 37 formed at one end of the flexible lift band 34. As explained previously, the hub 33 is provided with a square opening 35 to slidingly receive the square configuration outer rotating tube 50 so that the drum 32 rotates therewith but is permitted to be moved laterally along rotating tube 50. A clamping mechanism generally referred to as 78 is provided to manually clamp the hub 33 of drum 32 once it has been slid into the proper lateral position. This permits the drums 32 to be laterally positioned along outer tube 50 as desired corresponding to various width garage doors 10. The clamping mechanism 78 includes an eccentric locking cam 80 secured to lever 82 for rotation therewith. Lever 82 is journaled in holes 84 provided in hubs 33. Lever 82 includes an outwardly extending handle member 83 to facilitate manual rotation of the eccentric locking cam 80 from the clamped position shown in FIGS. 7 and 8 to an unclamped position to permit sliding lateral adjustment and reclamping of the drum 32 to the square tube 50.

Referring to FIGS. 1, 3, 6 and 11–13 the torsion spring counterbalance assembly 20 of the present invention includes a releasable safety interlock mechanism generally referred to at 86 which include locking collars 88 and 90. As previously explained, locking collar 88 is welded to the side of the center support bracket 24. The locking collar 88 is disposed about a circular opening in bracket 24 through which the torsion shaft 28 is journaled. A pair of tangs 92 spaced 180 degrees apart extend laterally away from the body of locking collar 88 and are disposed in openings formed between tangs 94 also spaced 180 degrees apart and extending laterally from the sliding locking collar 90 and disposed in the openings formed between the tangs 92. A locking screw 98 extends through a threaded hole in the body of the locking collar 90 holding it firmly in engagement with torsion shaft 28 in the position shown in FIGS. 1, 3, 11 and 12. After the counterbalance assembly 20 has been initially installed with the center support bracket 24 firmly secured to header 26 and the end support brackets 22 firmly secured to door frame members 14 and the flexible lift bands 34 have been properly attached to the bottom of door 10 and properly wound about drums 32, and the locking collars 52 have been properly positioned to secure the drums 32 for rotation with the torsion shaft 28 as will also be further explained later, the locking screw 96 threadably extending through the wall of collar 88 and engaging the torsion shaft 28 and thereby holding the torsion spring 30 in the pre-wound state can be unscrewed. After such initial installation has been completed and the locking screw 96 is removed, there should be only slight movement, if any, of the square shaft 28 as the preloaded torque of the torsion spring 30 is allowed to be transferred to the door 10 via the torsion shaft 28 to the drums 32 through the lifting bands 34 secured to the bottom of the door 10. If installation has been properly completed with lifting bands 34 properly secured from the bottom of door 10 to the drums 32 and with locking collars 52 properly securing the outer rotating tube 50 for rotation with shaft 28, and there is no failure of the center support bracket 24, and the lag screws securely hold bracket 24 to header 26, then tangs 92 will remain within the open space between tangs 94 of the sliding locking collar 90. However, if installation has not been properly completed or should a failure occur upon application of torque to the door upon removal of locking screw 96, then torsion shaft 28 will only be allowed to rotate approximately 60 degrees before tangs 94 engages tangs 92 preventing any further rotation of the torsion shaft 28 or unwinding of the torsion spring 30. Projections 99 provided on each side of both tangs 92 and tangs 94 interlock and prevent locking collars 88 and 90 from being forced apart from each other thereby maintaining the torsion spring in a stable condition. In this event, locking screw 96 is then screwed back into locking collar 88 and tightened against torsion shaft 28 to further preclude any additional rotation of shaft 28 or unwinding of torsion spring 30. Whatever problem caused this condition can then be corrected.

When there is either slight or no movement between tangs 94 relative to tangs 92 after removal of locking screw 96 and the tangs 92 and 94 remain in this neutral position, then locking screw 98 can be loosened permitting locking collar 90 to be slid away from locking collar 92 and locking screws 96 then retightened to maintain locking collar 90 away from locking collar 92 for normal operation in raising and lowering door 10.

Referring to FIGS. 1, 3, 11, 14 and 15 a cylindrical cover 102 may be provided around torsion spring 30. Cover 102 may be provided with circular end caps at 104 at both ends, each end cap 104 having a bearing 106 provided in a centrally disposed aperture with the torsion shaft 28 rotatably journaled through bearings 106. End caps 104 are secured to the cover 102 via a plurality of circumferentially spaced apart screws 108 which extend through cover 102 and are threadably received in an opening in angle members 110 welded to the inside of end caps 104. Cover 102 protects the torsion spring 28 from dust and other contaminants and corrosive environmental conditions. Cover 102 is optional, and either is not used in the preferred embodiment of the invention or is transparent so that the helix stripe on the outer circumference of the torsion spring 28 as previously described is plainly visible.

Referring to FIGS. 16–19, a bottom wire bracket 112 formed in a generally L-shaped configuration as seen in FIG. 17, is threaded through a loop 114 formed at the lower end of each of the flexible lift bands 34. The bottom wire bracket 112 includes an arcuate section formed to fit snugly about the lower end of bottom roller holder 116 on each side of door 10. The top ends of bottom wire bracket 112 are secured in place via screw 118 and cupped plate 120. A notch 122 is formed in the astragal weatherstrip 124 to receive the bottom section of wire bracket 112 directly against the bottom of the bottom section of garage door 10.

Referring to FIG. 19, door 10 is maintained in its fully open position by temporarily clamping a conventional C-clamp 126 or alternatively clamping the jaws of a pair of vice grips (not shown) to the inside of track 12 underneath the bottom roller 18 extending outwardly from the bottom roller holder 116. This permits any necessary adjustment of the tension of torsion spring 28 to be made with the minimum amount of torque resulting from the unwinding of torsion spring 28 with garage door 10 in the fully open position.

To adjust the tension on torsion spring 28 with garage door 10 in the fully raised position shown in FIG. 19. A standard crescent wrench or open end wrench is the only tool that is required. The wrench is used to engage the flats at the end 46 of the torsion shaft 28 to apply a slight tension to enable the locking collar 52 to be slid inward toward end support 22 and completely removed from the joint between outer end 46 and the square rotating tube 50. This allows the shaft 28 to be rotated relative to the rotating tube 50 which is held in place and thereby either increase or decrease the tension in the torsion spring 28 as desired. Once the desired tension is achieved, the locking collar 52 is slid outward to cover the joint between the outer end 46 and the rotating tube 50 and thereby secure the drum 32 to the torsion shaft 28 for rotation therewith. The inner surface of the locking collar 52 is configured to permit the outer end 46 to be adjusted in eight different positions relative to the outer tube 50 and thus provide for precise adjustment of torsion spring tension. Adding tension to one side can result in slack in the lifting band 34 on the opposite side. To take up such slack the wrench is used on the rotating tube 50 on this opposite side where there is slack in the lifting band 34 to hold the rotating tube 50 in place while the locking collar is slid outward away from the rotating tube 50 and clear of the joint between the rotating tube 50 and the outer extension 46. The rotating tube 50 is then turned via the wrench which in turn rotates the drum 32 to tighten the lifting band 34. Once this lifting band 34 has been tightened with the same tension as that of the opposite side lifting band 34 then the locking collar 52 is slid back into place over the joint between outer end 46 and rotating tube 50 so that the rotating tube 50 is locked in place for rotation with shaft 28 thereby locking drum 32 for rotation with torsion shaft 28. The C-clamp 126 is then removed for normal operation of the garage door 10.

While the foregoing detailed description of the preferred embodiment of the invention has been shown and described in considerable detail, it should be understood by those skilled in the art that many variations and changes can be made to these details without departing from the spirit and scope of the invention.

What is claimed is:

1. An overhead door pre-assembled and pre-loaded torsion spring counterbalance assembly for counterbalancing a certain amount of the weight of an overhead door movable in a guide channel between closed and open positions within the framework of a building structure comprising:

an elongated torsion shaft;

a pair of spaced apart end support brackets adapted to rotatably support the ends of said torsion shaft;

a center support bracket adapted for attachment to said building framework;

a torsion spring having one end secured to said center support bracket and a second end secured to said torsion shaft for rotation therewith;

a drum member secured adjacent each end of said torsion shaft for rotation therewith;

an elongated flexible member extending between each of said drum members and said overhead door for winding said elongated flexible members about said drum members upon rotation of said torsion shaft in one direction and unwinding of said torsion spring to assist in raising said door toward said open position and to unwind said elongated flexible members from said drum members and wind said torsion spring upon rotation of said torsion shaft in the other direction to assist in lowering said door toward said closed position; and releasable locking means for locking said torsion shaft to said center support bracket after said torsion spring is pre-loaded prior to attachment of said center support bracket to said building framework and thereby preventing said torsion shaft from being rotated by the tension of said pre-loaded torsion spring and for releasing said locking means after attachment of said center support bracket to said framework to enable said torsion spring to apply said pre-loaded tension to said torsion shaft and permit said torsion shaft to rotate said drums to wind said elongated flexible members about said drums to assist in raising said door toward said open position.

2. The overhead door pre-assembled and pre-loaded torsion spring counterbalance assembly of claim 1 further comprising:

stop means for limiting the rotation of said torsion shaft relative to said center support bracket upon releasing said locking means.

3. The overhead door pre-assembled and pre-loaded torsion spring counterbalance assembly of claim 2 wherein said stop means comprises a stop member mounted on said torsion shaft for rotation therewith, said stop member slidable from a first position adjacent said locking means for enabling said stop means to limit the rotation of said torsion shaft relative to said center support bracket toward a second position away from said locking means for permitting full rotation of said torsion shaft relative to said center support bracket.

4. The overhead door pre-assembled and pre-loaded torsion spring counterbalance assembly of claim 3 wherein said locking means comprises a locking collar disposed at an opening in said center support bracket, said locking collar provided with at least one projection extending therefrom, said stop member provided with at least one projection extending therefrom, said projections of said locking collar and said stop member spaced apart from each other prior to releasing said locking means.

5. The overhead door pre-assembled and pre-loaded torsion spring counterbalance assembly of claim 4 wherein said projections extending from said locking collar and said stop member remain spaced apart from each other after releasing said locking means for providing a visual indication of proper installation of said pre-assembled and pre-loaded torsion spring counterbalance assembly to said building framework and said overhead door.

6. The overhead door pre-assembled and pre-loaded torsion spring counterbalance assembly of claim 5 wherein one of said projections of said locking collar and said stop member is rotated into engagement with the other of said projections both for limiting the rotation of said torsion shaft relative to said center support bracket and for providing a visual indication of an improper installation of said pre-assembled and pre-loaded torsion spring counterbalance assembly to said building framework or said overhead door.

7. The overhead door pre-assembled and pre-loaded torsion spring counterbalance assembly of claim 4 wherein said locking collar and said stop member each include a set screw threadably mounted therein.

8. The overhead door pre-assembled and pre-loaded torsion spring counterbalance assembly of claim 1 wherein said releasable locking means comprises a collar disposed at an opening through said center support bracket, said elongated torsion shaft rotatably journaled in said center support bracket opening, a locking member cooperating with said locking collar to releasably engage said torsion shaft.

9. The overhead door pre-assembled and pre-loaded torsion spring counterbalance assembly of claim 1 wherein said releasable locking means comprises a set screw threadably mounted in said locking means.

10. A torsion spring counterbalance mechanism for counterbalancing an overhead door movable between a closed position and an open position comprising:

a torsion shaft rotatable about its longitudinal axis;

mounting means for rotatably supporting said torsion shaft above said overhead door;

a torsion spring disposed about said torsion shaft and having one end secured to said torsion shaft to unwind said torsion spring upon rotation of said torsion shaft in one direction about its longitudinal axis and to wind said torsion spring upon rotation of said torsion shaft in the other direction;

a pair of spaced apart drum members, one of said drum members disposed adjacent each end of said torsion shaft and engageable with said torsion shaft for rotation therewith, at least one of said drum members adapted for disengagement from rotation with said torsion shaft;

an elongated flexible lifting member extending between each of said drum members and said door to raise said door toward said open position upon rotation of said torsion shaft in said one direction and to lower said door toward said closed position upon rotation of said torsion shaft in said other direction; and manually actuatable locking means disposed between said at least one drum member and the end of said torsion shaft adjacent thereto, said manually actuatable locking means for unlocking said at least one drum member from engagement with said torsion shaft and thereby freeing said at least one drum member from rotation with said torsion shaft to allow the tension of said torsion spring to be adjusted by manually rotating said torsion shaft with said at least one drum member disengaged from said torsion shaft, said manually actuatable locking means for selectively locking said at least one drum member into engagement with said torsion shaft after adjustment of said torsion spring.

11. The torsion spring counterbalance mechanism of claim 10 wherein said manually actuatable locking means comprises a locking collar adapted for slidable engagement with said torsion shaft.

12. The torsion spring counterbalance mechanism of claim 11 wherein said torsion shaft has a plurality of wrench flats provided along one end of said torsion shaft, said at least one drum member including a rotatable hub, said hub provided with a provided of wrench flats, said locking collar provided with a multi-faceted interior for engaging the wrench flats on both said hub and said torsion shaft.

13. The torsion spring counterbalance mechanism of claim 12 wherein the exterior configuration of said torsion shaft is substantially square and said hub includes an extension substantially square in exterior configuration.

14. The torsion spring counterbalance mechanism of claim 13 wherein the multi-faceted interior of said locking collar is substantially star shaped and complementary to the exterior configuration of said torsion shaft and said hub extension in either of at least two positions to provide adjustment of said torsion shaft relative to said hub extension for precisely adjusting the tension of said torsion spring.

15. A torsion spring counterbalance mechanism for counterbalancing an overhead door movable between a closed position and an open position comprising:

a torsion shaft rotatable about its longitudinal axis;

mounting means for rotatably supporting said torsion shaft above said overhead door;

a torsion spring disposed about said torsion shaft and having one end secured to said torsion shaft to unwind said torsion spring upon rotation of said torsion shaft in one direction about its longitudinal axis and to wind said torsion spring upon rotation of said torsion shaft in the other direction;

a pair of spaced apart drum members, one of said drum members disposed adjacent each end of said torsion shaft and engageable with said torsion shaft for rotation therewith, at least one of said drum members adapted for disengagement from rotation with said torsion shaft;

an elongated flexible lifting member extending between each of said drum members and said door to raise said door toward said open position upon rotation of said torsion shaft in said one direction and to lower said door toward said closed position upon rotation of said torsion shaft in said other direction; and manually actuatable locking means for unlocking said at least one drum member from engagement with said torsion shaft and thereby freeing said at least one drum member from rotation with said torsion shaft to allow the tension of said torsion spring to be adjusted by manually rotating said torsion shaft with said at least one drum member disengaged from said torsion shaft, said manually actuatable locking means for selectively locking said at least one drum member into engagement with said torsion shaft after adjustment of said torsion spring.

16. The method of pre-winding and installing a torsion spring counterbalance assembly to an articulating overhead garage door movable within a guide channel between closed and open positions within the framework of the garage door opening, the assembly comprising a torsion spring having one end connected to a torsion shaft for rotation therewith and the other end connected to a center support bracket, a pair of drums selectively engageable for rotation with the torsion shaft, elongated flexible lift members connectable between said drums and said door for moving the door between the closed and open positions upon rotation of said torsion shaft in opposite directions, comprising the steps of:

pre-winding the torsion spring connected to said torsion shaft to pre-load the torsion spring;

releasably locking the torsion shaft to the center support bracket to maintain said pre-wound torsion spring in said preloaded state;

attaching the center support bracket to the garage door opening framework;

rotatably supporting the opposite ends of the torsion shaft above said garage door;

attaching said lift members to said garage door;

unlocking said torsion shaft from said center support bracket and thereby transferring the tension from said pre-loaded torsion spring to said garage door via said torsion shaft, said drums and said attached lift members;

disengaging at least one of said drums to be free from rotation with said torsion shaft;

rotating said torsion shaft without rotating said disengaged drum to increase or decrease the tension of said torsion spring;

re-engage said at least one drum for rotation with said torsion shaft.

* * * * *